US005845806A

United States Patent [19]

Parchman

[11] Patent Number: 5,845,806

[45] Date of Patent: Dec. 8, 1998

[54] INFLATABLE INSULATING JACKET FOR BEVERAGE CONTAINER

[76] Inventor: William J. Parchman, 8150 Spruce Valley Dr., Fort Worth, Tex. 76137

[21] Appl. No.: 862,717

[22] Filed: May 23, 1997

Related U.S. Application Data

[60] Provisional application No. 60/018,535, May 29, 1996.

[51] Int. Cl.[6] ..... B65D 25/34

[52] U.S. Cl. ..... 220/739; 220/903; 206/522; 383/3; 383/63

[58] Field of Search ..... 383/3, 63; 206/522; 220/903, 739, 737

[56] References Cited

U.S. PATENT DOCUMENTS

| | | | |
|---|---|---|---|
| 3,742,994 | 7/1973 | Pensak | 383/3 |
| 3,987,736 | 10/1976 | Miller . | |
| 4,164,970 | 8/1979 | Jordan . | |
| 4,465,188 | 8/1984 | Soroka et al. | 383/3 |
| 4,540,611 | 9/1985 | Henderson . | |
| 4,705,085 | 11/1987 | Brown . | |
| 4,858,755 | 8/1989 | Kuivanen | 383/3 |
| 4,941,754 | 7/1990 | Murdock | 383/3 |
| 5,134,930 | 8/1992 | Mei-Hwa . | |
| 5,135,132 | 8/1992 | Potochnik . | |
| 5,178,281 | 1/1993 | Enzu . | |
| 5,588,532 | 12/1996 | Pharo | 206/522 |

FOREIGN PATENT DOCUMENTS

| | | | |
|---|---|---|---|
| 2 218 401 | 11/1989 | United Kingdom | 206/522 |

*Primary Examiner*—Stephen J. Castellano
*Attorney, Agent, or Firm*—Richard C. Litman

[57] ABSTRACT

An inflatable beverage container insulating jacket, more particularly, a jacket which when collapsed conveniently stores in a credit-card sized pouch for carrying in a wallet or purse. The insulating jacket includes a generally cylindrical inflatable wall and a base unitarily attached to the wall, which when inflated forms the receiving space for the container. Both the wall and the base are made up of an interior partition and an exterior partition peripherally attached to one another, thus defining an interiorly disposed chamber for rigid inflation of the wall. An inflation valve having a minimal dimension, such as a resealable compression-type zipperless closure, is attached to the wall along a top edge of the wall, the valve permitting rigid inflation of the unitary base and wall by virtue of a plurality of interconnected air cells. Each air cell is defined in the wall and base by a plurality of tacking welds. When deflated, the jacket can be collapsed to credit-card sized dimensions and carried in an approximately credit-card sized pouch by virtue of its planar dimensions and minimally dimensioned valve. A method of construction which accommodates the objective of maintaining a very thin profile and planar dimensions of the jacket when collapsed is also described.

5 Claims, 4 Drawing Sheets

INFLATABLE INSULATING JACKET FOR BEVERAGE CONTAINER

CROSS-REFERENCE TO RELATED APPLICATION

This application claims the benefit of U.S. Provisional patent application Ser. No. 60/018,535, filed May 29, 1996.

BACKGROUND OF THE INVENTION

1. Field of the Invention

The present invention relates to an inflatable insulating jacket for use with a beverage container, more particularly, a jacket adapted to be deflated and collapsed for storage in a credit-card sized pouch, permitting convenient carrying in a wallet or purse.

2. Description of the Prior Art

Flexible materials have long been used in manufacturing articles which, when inflated under pressure, provide a rigid form. This general construction concept is usually applied when the article of manufacture is to have one or more of numerous desirable properties: cushioning against impact, thermal insulation, or collapsibility, for example. Inflatable devices making use of such properties which have been specifically directed toward uses with containers are known.

A first group of patents describing such inflatable products emphasizes their use as cushioning jackets. U.S. Pat. No. 3,987,736 issued Oct. 26, 1976 to Miller describes a reusable pneumatic dunnage device to absorb impacts to shipped containers by utilizing an elongated tube filled with air and disposed between two parallel elongate stop members, such assembly being vertically placed between two parcels of stacked plywood tiers. U.S. Pat. No. 5,178,281 issued Jan. 12, 1993 to Enzu describes a barrel-shaped balloon cushioning package. Although inflatable, each such device is both dissimilar from the present invention structurally and dissimilar in its intended purposes.

A second group emphasizes the collapsible property of an inflatable article serving as a container. For example, U.S. Pat. No. 4,164,970 issued Aug. 21, 1979 to Jordan describes an inflatable tote bag having a flexible side wall of sheet material defining a plurality of inflatable cells, an air valve, and a pair of inflatable end walls. In addition a zipper or other closure means is included. However, this invention teaches away from the present invention in so far as both end walls must be present for the Jordan invention to serve as a tote bag. Likewise, U.S. Pat. No. 5,135,132 issued Aug. 4, 1992 to Ptochnik describes an inflatable beverage container defined by inflatable walls with a V-shaped upper lip and a handle. This inflatable mug is intended to be used as a drinking cup and therefore must be structurally capable of holding fluids without leakage, unlike the present invention.

A third group describes insulative beverage container holders. U.S. Pat. No. 5,134,930 issued Aug. 4, 1992 to Mei-Hwa describes an inflatable serving tray with beverage container pockets, not intended for single beverage container use.

Most notably, U.S. Pat. No. 4,705,085 issued Nov. 10, 1987 to Brown describes an inflatable beverage insulator wherein a container receptacle is defined by a jacket portion and a base portion integral therewith. The pattern, when viewed flat and unattached upon itself, shows a base which depends from the corner of a generally rectangular jacket. The base includes a separately attached valve stem with a slidable member which requires a special welding step for attachment. Unlike the present invention, this valve stem is a tubular device not conducive to flattening; therefore the Brown invention is incapable of being reduced to fit a credit-card sized pouch.

Moreover, the tubular valve of the Brown patent must be passed through a mounting collar formed in the jacket, thus adding complexity to the method used to assemble the beverage container insulator. The Brown patent also teaches that, after the tubular valve is passed through the mounting collar, a locking ring must be added to prevent removal of the tube, and presumably, prevent the base of the insulator to fall free. No welds attaching the base to the jacket are noted. The tubular valve of the Brown patent also requires a locating-opening to partially restrain the tube, whereas, in the present invention, the valve can be easily folded over and into the cavity for receiving a container to be hidden from view. Thus, the position of the tubular valve is highly limiting to the structure of the Brown invention.

Finally, U.S. Pat. No. 4,540,611 issued Sep. 10, 1985 to Henderson relates to the method of production of beverage container insulators and describes a fold-up insulated beverage container holder die cut from a single piece of insulative foam. The piece is joined along opposing edges by folding upon itself and welding or sewing to form the holder. However, the Henderson patent fails to teach either a method of forming the present invention or the inclusion of inflatable cells to form the container jacket.

None of the above inventions and patents, taken either singly or in combination, is seen to describe the instant invention as claimed.

SUMMARY OF THE INVENTION

The present invention relates to an inflatable insulating jacket for use with a beverage container, more particularly, a jacket adapted to be collapsed into a planar sheet, which in turn can be folded for convenient storage in a credit-card sized pouch sized to be carried in a wallet or purse. The insulating jacket: when in its inflated state receives a beverage container such as a can or bottle and provides an insulative layer to the container while in use. The insulating jacket includes a generally cylindrical inflatable wall and a base unitarily attached to the wall, which combination forms the receiving space for the container. Both the wall and the base are made up of an interior partition and an exterior partition peripherally attached to one another, thus defining an interiorly disposed chamber for receiving a fluid medium for inflation into a useful insulative jacket.

An inflation valve having a minimal dimension in profile, such as a resealable compression-type zipperless closure, e.g. the seal as commonly used on ZIPLOC® plastic bags, is attached to the wall along a top edge of the wall, the valve permitting rigid inflation of the unitary base and wall by virtue of a plurality of interconnected air cells. Each air cell is defined in the wall and base by a plurality of tacking welds. Each such weld attaches the interior partition to the exterior partition thus subdividing the interior chamber defined between the partitions into the air cells. When deflated, the jacket can be collapsed to credit-card sized dimensions and carried in an approximately credit-card sized pouch by virtue of its planar dimensions and minimally dimensioned valve.

A method of production which achieves the objective of maintaining a very thin profile and planar dimensions when the jacket is collapsed is also described.

Accordingly, it is a principal object of the invention to provide an inflatable insulating jacket for use with beverage containers.

It is another object of the invention to provide an inflatable beverage container insulating jacket which when collapsed allows a very thin profile and planar dimensions.

It is a further object of the invention to provide an inflatable beverage container insulating jacket having an improved thin-profile valve and method of manufacturing same.

Still another object of the invention is to provide an inflatable beverage container insulating jacket which, in combination with a credit-card sized pouch or without, can be reduced in profile to be easily carried and transported in a wallet or credit-card pocket.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features, consistently throughout the attached drawings.

DETAILED DESCRIPTION OF THE PREFERRED EMBODIMENT

The present invention relates to an inflatable insulating jacket for use with beverage containers, more particularly, a jacket suitably adapted to be collapsed by deflation into a planar state which may then be folded for introduction into and convenient storage in a credit-card sized pouch.

Figure 1:
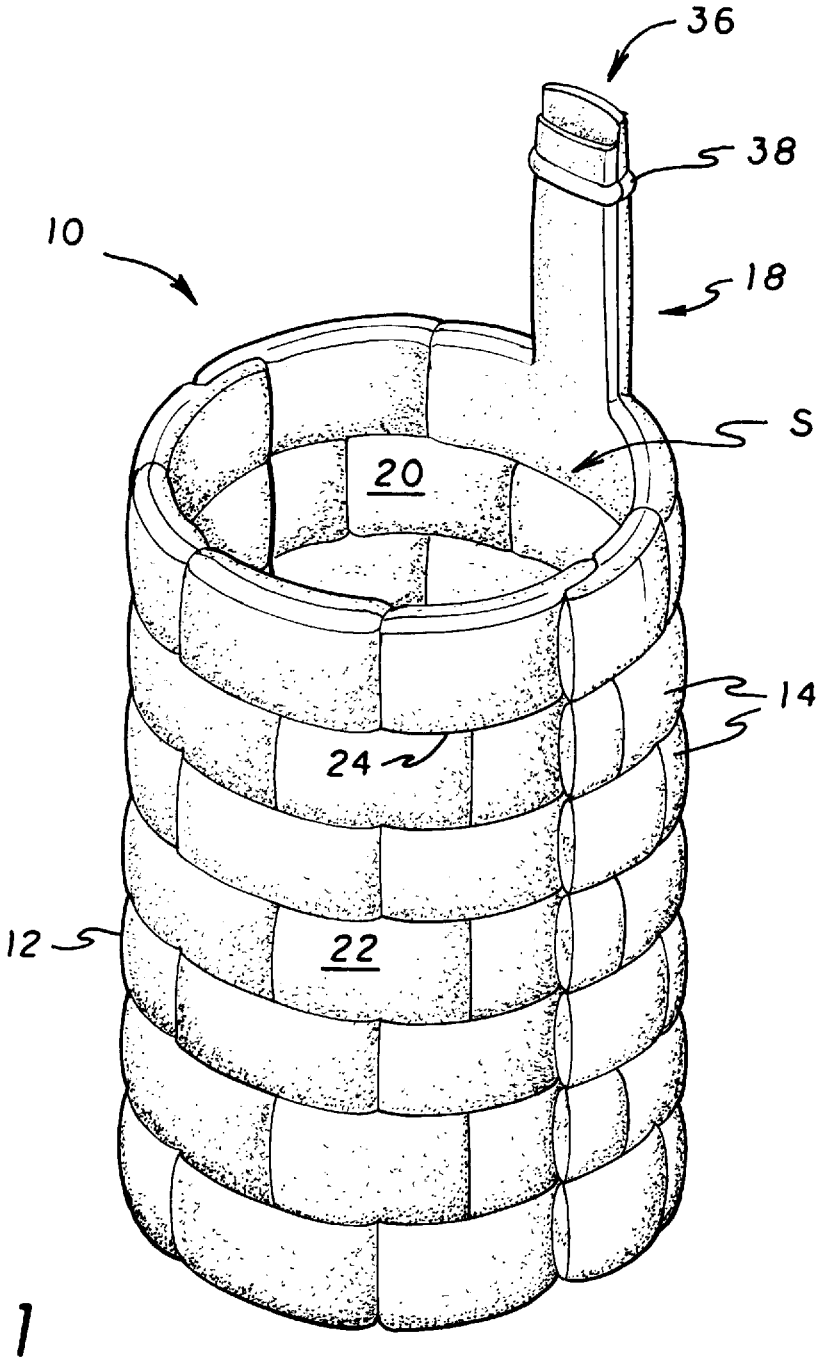
FIG. 1 is a perspective view of the inflatable beverage container insulating jacket.

Referring first to FIG. 1, the insulating jacket 10 is shown in its inflated state, ready to receive a beverage container such as a can or bottle. The inflated insulating jacket 10 provides an insulating environment while the container is held within the jacket. The jacket 10 is sized when inflated to have an inner diameter which approximates the standard diameters of various beverage bottles and cans, such that when a bottle or can is received by the jacket, the jacket remains frictionally engaged to the beverage can or bottle.

The insulating jacket 10 includes a generally cylindrical inflatable wall 12 and a base 16 (not shown in FIG. 1; see FIG. 2) unitarily attached to the wall 12, which combination forms the receiving space S for the container. Both the wall 12 and the base 16 are made up of an interior partition 20 and an exterior partition 22 of essentially identical pattern. One partition is attached at least along its periphery to another to define an interiorly disposed chamber for receiving a fluid inflation medium, such as air or if desired a liquid, to inflate the wall 12. An inflation valve 18 is attached to the wall 12 permitting rigid inflation by mouth of the unitary base 16 and wall 12. The wall and base are further subdivided into a plurality of interconnected air cells 14 defined by a plurality of tacking welds 24. Each weld 24 attaches the interior partition 20 to the exterior partition 22 thus also subdividing the interior chamber defined between the partitions into the plurality of air cells 14 and further defining a sufficient number of passages 26 (FIG. 2) to allow inflation of all the cells 14. The frictional engagement of the jacket 10 to a beverage container is promoted by the resilient nature of such air cells 14 when inflated. Moreover, a limited range of different diameter containers may thus be accommodated by the receiving space S of the jacket 10.

The materials used in the construction of the insulating jacket 10 are chosen from any material which is preferably flexible, resilient, and capable of permitting inflation and withstanding inflation pressures, and may be plastic, vinyl, or rubber-like materials. The material must further provide the ability to be resiliently folded into a planar, thin arrangement, whereby the deflated, collapsed jacket 10 can be carried in an approximately credit-card sized pouch. A credit-card approximates 54 mm in width and 86 mm in length, having a nominal thickness. Although the preferred embodiment is desired to ideally approach these dimensions, the dimensions are to be understood as exemplary of the minimal thickness and size of the jacket and not limiting.

Figure 7:
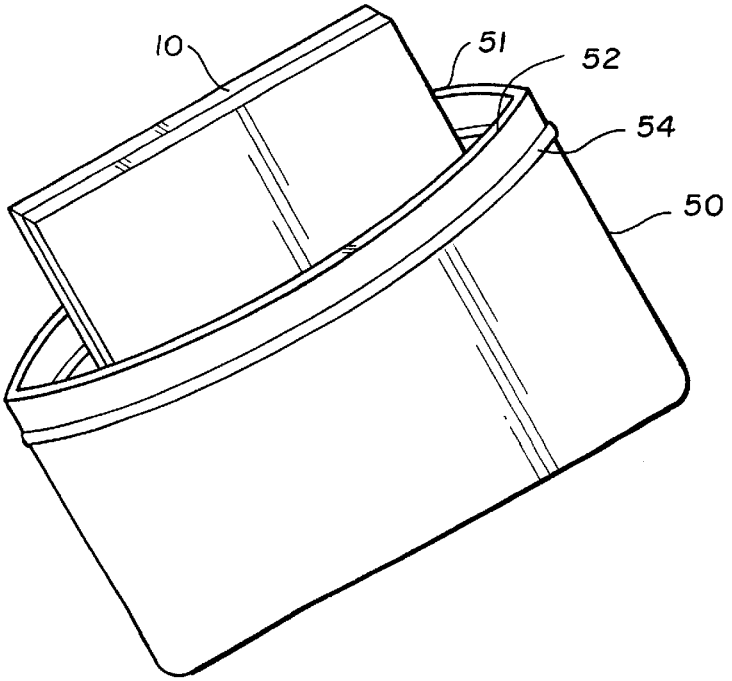
FIG. 7 is a perspective view of the inflatable insulating jacket in a deflated condition in combination with a sealable storage pouch shown partially receiving the deflated beverage container insulating jacket.

One such arrangement is suggested by FIG. 7, wherein the jacket 10 is shown to be partially inserted into a pouch 50. The pouch 50 includes two walls 51, 52 having a closure 54 for sealing of the pouch 50. The closure 54 is chosen for being minimal in dimension in profile; a suitable closure is a resealable compression-type zipperless closure, such as the type of sealing means as commonly used on ZIPLOC® plastic bags and known in the prior art. The pouch 50 is dimensioned to closely receive an object the size of a credit-card. A suggested dimension for the pouch is approximately 2.5 inches by 3.75 inches in width and length respectively, having at least three of the four edges of the walls welded to form the pouch, and being having a nominal thickness necessarily resulting from the addition of a closure 54 along its fourth edge.

The exterior partition 22 of the insulating jacket 10 is suitable for addition of printed matter and may be used for advertising; however other decorative display may be incorporated as well. For example, as suggested by FIG. 1, by patterning the welds 24, any of a plurality of three dimensional patterns can also be created which appear on the exterior partition 22 to provide a decorative appearance. Suggested patterns include air cells 14 together defining spirals, blocks, concentric circles and rectangles. The welds 24 must allow a passage between each of the cells 14 to allow inflation, an exemplary passage 26 being suggested in FIG. 2. Numerous other passages are shown unnumbered, FIG. 2 also illustrates two planar, overlying sheets of the previously suggested sheet material cut in the preferred pattern 30 for construction of the jacket 10. The pattern 30 comprises the base 16 interspaced between two rectangular wall portions 12*a*, 12*b* which together form the wall 12 after welding. A weld (unnumbered continuously extends around the periphery of the two overlying sheets forming pattern 30, excepting the terminal end 36 of the inflation valve 18 where the weld is discontinued. The weld provides a pneumatic seal of the two overlying sheets to permit inflation of the jacket through the terminal end 38 through a channel C defined by the inflation valve 18 (as best appreciated from FIG. 5). The welds 24 may be created by use of any suitable gluing or welding techniques known in the prior art, including employing the use of adhesives, chemical bonding agents, heat, or dielectric welding, whereby a pneumatically leakproof seal is formed.

Figure 5:
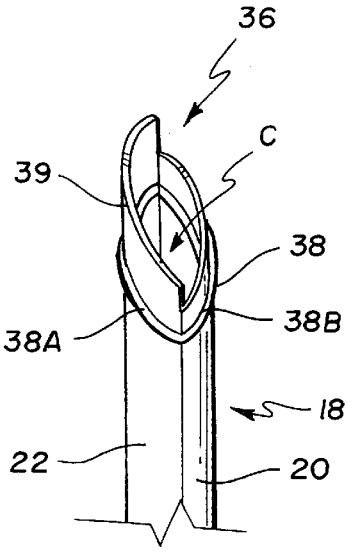
FIG. 5 is a fragmented, perspective view of the inflation tube in an open state.
Figure 6:
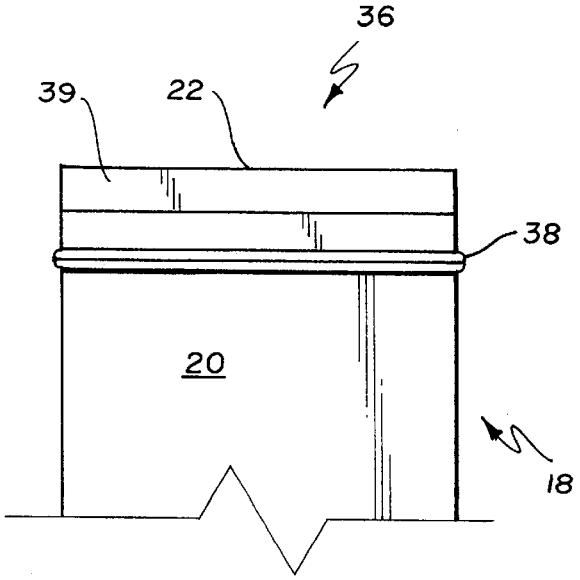
FIG. 6 is a fragmented, enlarged side view of the inflation tube in a sealed state.

As more clearly shown in FIGS. 5 and 6, the inflation valve 18 is defined by the interior partition 20 and the exterior partition 22 being welded along the longitudinal edges of the valve partitions 20, 22, the weld terminating at the terminal end 36. In an open state, as shown in FIG. 5, the valve walls 20, 22 are separated to form a channel C leading into the air cells 14 of wall portion 12*a*. When inflating the jacket 10, such separation may be achieved by manually compressing the welded longitudinal edges between the thumb and the forefinger.

After a previous inflation, the walls 20, 22 may be moist and prone to adhesion to one another. To aid the release of the walls 20, 22 from one another under such conditions, a lip 39 of wall 22 has been provided, which lip 39 extends beyond the terminal end of wall 20, thereby allowing a user to grasp the lip 22 and peel back the lip 22 to help break the adhesion.

As previously noted, the terminal end 36 of the inflation valve 18 is provided with a valve closure 38 which is chosen for being minimal in dimension and having a highly planar profile when the jacket is deflated. In the preferred embodiment a resealable compression-type zipperless closure, as commonly used on ZIPLOC® plastic bags and known in the prior art, is suggested as suitable for adaptation to the present invention. The compression-type zipperless closure valve 38 is comprised of opposing and mating plastic strips 38*a*, 38*b* together forming a reclosable seal, each strip thermally welded or otherwise bonded or adhered to an opposing sheet of plastic or similar sheet material. Such closure valve 38, being nominal in thickness, further permits the streamlined and planar arrangement of the jacket 10 and pouch 50 as suggested by FIG. 7.

Each of these mating plastic strips 38*a*, 38*b* protrude from the outside walls 22, 20 of the valve 18, thereby facilitating a user's ease of inflating the jacket 10. While the valve channel C is open and held between the fingers to be inflated by mouth, as the user begins to blow on the valve 18, it may begin to slip forward due to the force of inflation against the chamber walls. The protruding strips 38*a*, 38*b* provide a gripping surface to prevent expulsion of the valve 18 from between the lips of the user.

As applied to the present invention, such plastic strips 38*a*, 38*b* can be easily formed or attached, by techniques known in the prior art, to a desired sheet material prior to die cutting and welding of the pattern from the sheet material. For example, a pair of continuous rolls of sheet material may include a different one of the pair of mating plastic strips of the compression-type zipperless closure, each one running continuously along one long edge of the sheet material. From such sheet material a blank of each the interior partition 20 and exterior partition 22 may be cut in the preferred pattern 30, thus providing the two overlying sheets necessary to form the jacket, each one already having the valve closure 38 positioned in place. Thus, any subsequent assembly of the jacket 10 can occur without the additional step necessary for the placement of a separate valve.

Therefore, a method of producing the jacket 10 is provided which, first, includes obtaining sheet material having a compression-type closure 38 running longitudinally and continuously along the sheet material, the sheet material being of adequate dimension to cut mating pairs of blank sheets, wherein a different one of the mating strips 38*a*, 38*b* is attached to the blank. Each sheet material is preferably cut using a die cutting technique. Because the pattern 30 is symmetrical through one axis, along its length with the centerline bisecting the inflation valve, each sheet material blank may be die cut into the described pattern 30 from sheet material either individually or in stacked overlying pairs.

If the mating strips 38*a*, 38*b* are aligned and pressed closed (permitting the first sheet to overlay the second sheet as a stacked pair of sheets), the method provides that the stacked sheets can be simultaneously cut and welded along the peripheral edges and along the suggested tack weld positions, thus creating the interior chamber and air cells as the blank is being cut and with the valve closure 38 in place. Thus a product for final assembly of the jacket 10 can be economically and easily made, in a minimum number of steps, using known die cutting and welding techniques. Final assembly of the jacket 10 can then take place, as described below.

Figure 2:
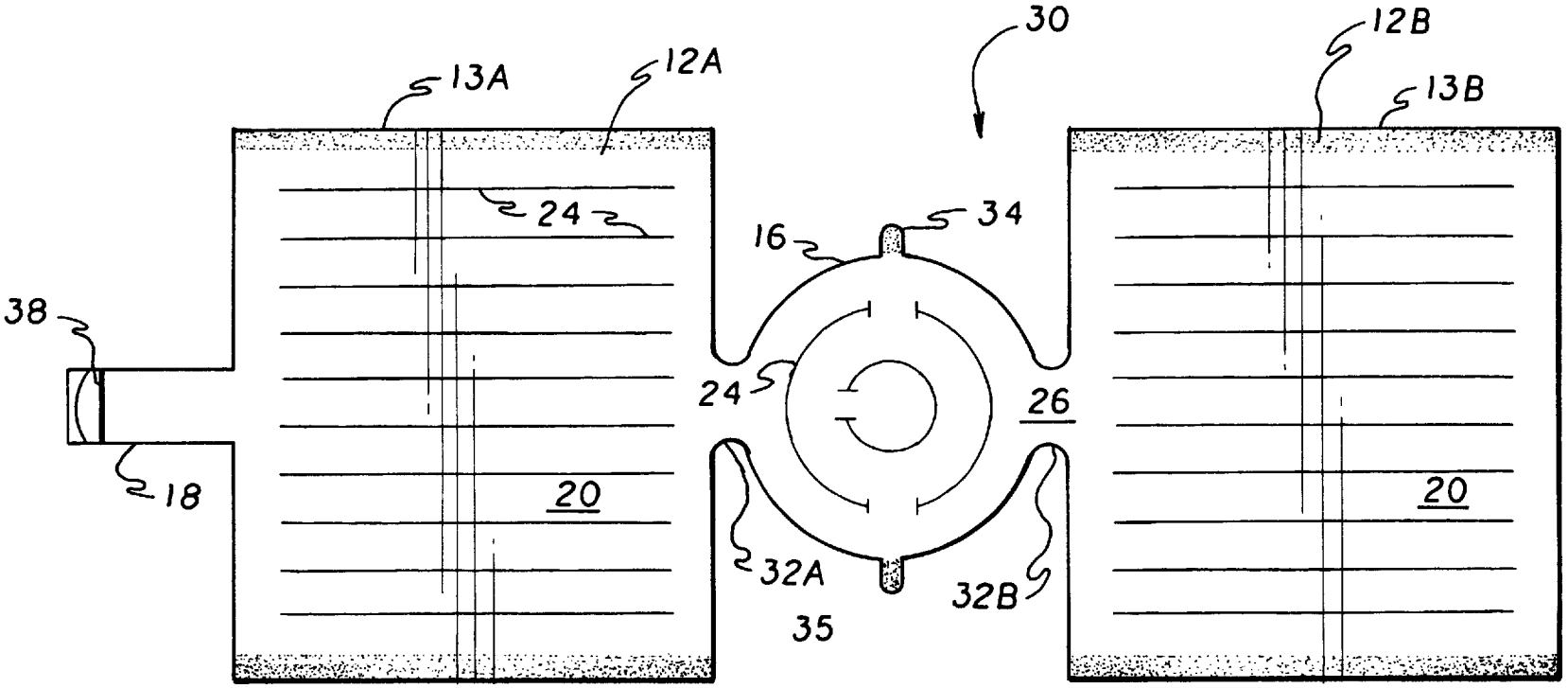
FIG. 2 is a top plan view of a sheet material die cut and welded for use in assembly of the inflatable beverage container insulating jacket.

A further benefit of the pattern 30 as illustrated in FIG. 2 is that the base 16 is provided with an integral connection 32*a*, 32*b* causing the base 16 to be attached to the wall 12 at two opposing positions, thereby improving the strength of the attachment of the base to the walls. Moreover, the need for a complex weld and multiple added steps for inserting a valve, etc, as suggested by the prior art, is avoided present pattern.

Figure 4:
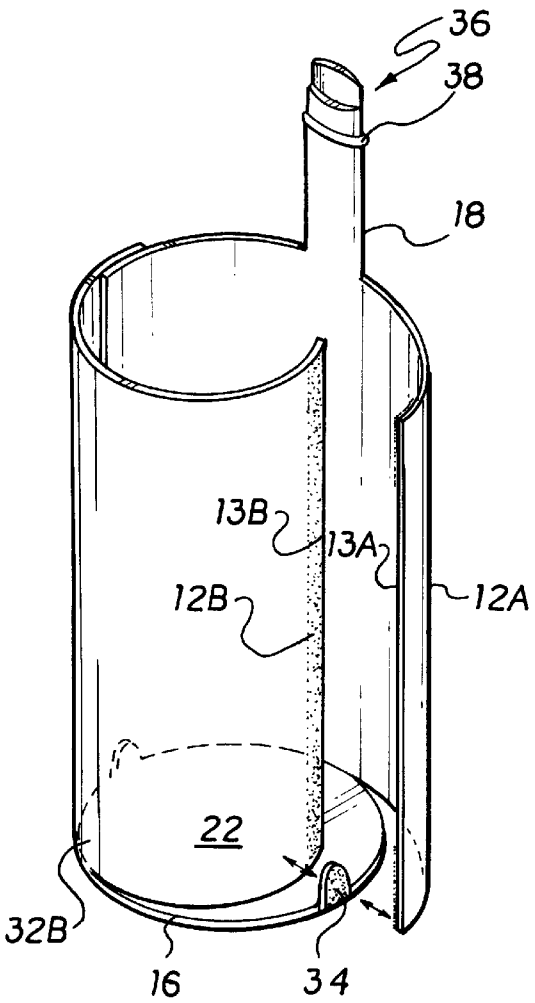
FIG. 3 and FIG. 4 are perspective views of the sheet material representing a first state of assembly (FIG. 3) and a second successive state of assembly (FIG. 4).

By referring to both FIG. 4 and 5 together, the method of final assembly of the jacket 10 can be understood. First generally describing the final structural features of the product relevant to the method, a seam weld is required at each of edges 13*a*, 13*b* in order to attach wall portions 12*a*, 12*b* to one another to form the receiving space S of the jacket 10, as suggested by FIG. 4. Two tabs 34, 35 are provided as added attachment points for the base 16 to be attached to the wall portions 12*a*, 12*b*, thereby providing a four point attachment for added strength.

Figure 3:
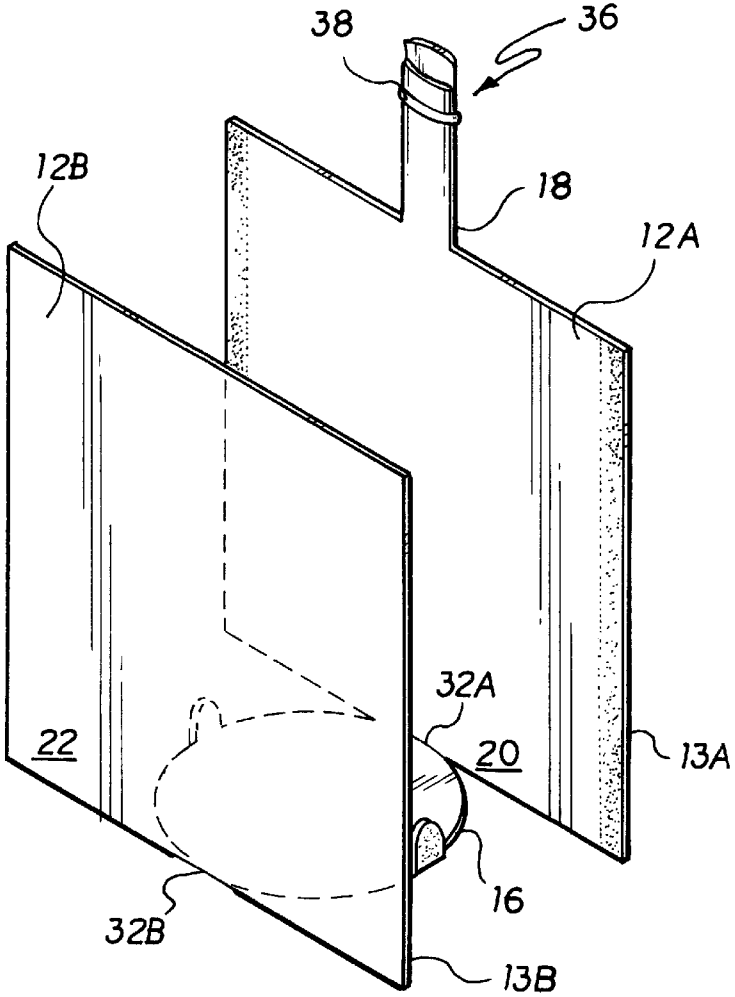

It can be observed that, by bending integral connections 32*a*, 32*b* the wall portions 12*a*, 12*b* can be brought into generally perpendicular relation to the base 16, whereupon the edges 13*a*, 13*b* can be attached upon tab 34 and upon one another by placing a tacking weld 24 along such edges and upon tab 34. The opposing edges are attached in a similar manner. It should be noted and understood that, for clarity of illustration, FIGS. 3 and 4 are illustrated in a simplified manner wherein the tack welds 24 or other seams and the inflatable cells between each of the wall portions 12*a*, 12*b* are not identified, and as such, wall 12 should be understood to be defined as including such features consistent with the disclosure herein.

A final aspect of the pattern 30 is consistent with the objective of folding of the fully assembled jacket into a planar credit-card sized article. When assembled, the wall 12 is attached by the bridges at 34, 35, 32*a*, 32*b* to the base 16. Between each adjacent bridge, a stress-relief opening is defined. For example, as can be seen in FIG. 4, tab 34 and integral connection 32*b*, an opening is formed when each of the wall portions 12*a*, 12*b* are joined. When the jacket 10 is flattened by folding the base across its diameter from tab 34 to tab 35 back upon itself thereby causing a fold across 32*a* and 32*b*, the openings allow the base to retreat from the edges of the wall 12 and readily fold and conform to a planar configuration. Were the base circumferentially attached the lower edge of wall 12, stresses caused by folding would prevent the desired near planar arrangement for ready insertion as previously described.

It is to be understood that the present invention is not limited to the sole embodiment described above, but encompasses any and all embodiments within the scope of the following claims.

I claim:

1. An inflatable insulating jacket, comprising:

a generally cylindrical inflatable wall portion, defining an interior for receiving a container and having a bottom edge and a top edge, said wall portion being comprised of an interior partition and an exterior partition peripherally attached to one another by a pneumatically tight seal thereby defining an interiorly disposed chamber permitting inflation of said wall portion;

a base having at least two bridges each integrally attached to said wall portion along opposing portions of said bottom edge, said base comprising an interior partition and an exterior partition peripherally attached to one another by a pneumatically tight seal and defining an interiorly disposed chamber for inflating said base in pneumatic communication through each said bridge with said interiorly disposed chamber of said wall portion, said base further defining a pair of opposingly positioned tabs attached to said bottom edge of said wall portion;

a plurality of interconnected air cells defined in said wall portion and said base by a plurality of tacking welds attaching the interior partition to the exterior partition; and an inflation valve attached along said top edge in operable communication with said interiorly disposed chamber of said wall portion;

whereby said base and said wall portion defines a unitary construction for receiving a container and said valve permits rigid inflation of said unitary construction by virtue of said plurality of interconnected air cells.

2. The jacket according to claim 1, wherein said inflation valve includes a resealable compression-type zipperless closure including mating, sealable strips.

3. The jacket according to claim 2, wherein said inflation valve comprises a flattened tubular sleeve attached to said top edge and having a terminal end diametrically opposite said top edge, said resealable compression type zipperless closure releasably sealing said terminal end.

4. The jacket according to claim 3, wherein said inflation valve further includes a lip extending from one of said mating, sealable strips of said resealable compression type zipperless closure.

5. The jacket according to claim 2, wherein each of said mating, sealable strips of said resealable compression type zipperless closure forms a protruding ridge facing exteriorly.

* * * * *